United States Patent [19]

Flor et al.

[11] Patent Number: 4,542,947

[45] Date of Patent: Sep. 24, 1985

[54] LOCKING ASSEMBLY FOR FLUORESCENT LAMPS

[75] Inventors: Joseph R. Flor, Livingston; Richard F. Havens, Watchung; Peter Panayoti, Wallington, all of N.J.

[73] Assignee: Midland-Ross Corporation, Cleveland, Ohio

[21] Appl. No.: 616,911

[22] Filed: Jun. 4, 1984

[51] Int. Cl.[4] ..... H01R 33/10

[52] U.S. Cl. ..... 339/54; 339/56; 339/91 L

[58] Field of Search ..... 339/54, 56, 50 R, 53, 339/91 L, 253 R, 252 R

[56] References Cited

U.S. PATENT DOCUMENTS

| | | | |
|---|---|---|---|
| 2,252,340 | 8/1941 | Bryant et al. | 339/54 |
| 2,303,156 | 11/1942 | Bryant et al. | 339/54 |
| 2,317,163 | 4/1943 | Young | 339/53 |
| 2,702,377 | 2/1955 | Dahlhaus et al. | 339/54 |
| 2,955,274 | 10/1960 | Binder et al. | 339/54 |
| 3,723,945 | 3/1973 | Detch | 339/54 |
| 3,818,418 | 6/1974 | Detch | 339/54 |
| 3,851,295 | 11/1974 | Geier | 339/54 |
| 3,892,457 | 7/1975 | Detch et al. | 339/54 |
| 4,306,758 | 12/1981 | Johnson et al. | 339/54 |

FOREIGN PATENT DOCUMENTS

| | | | |
|---|---|---|---|
| 1003354 | 2/1957 | Fed. Rep. of Germany | 339/54 |
| 1962168 | 12/1969 | Fed. Rep. of Germany | 339/54 |
| 0676278 | 7/1952 | United Kingdom | 339/54 |

OTHER PUBLICATIONS

Photographs of Pauluhn Mechanism.
Leviton Flier.
McGill Tubeloc Flier.

*Primary Examiner*—Gil Weidenfeld
*Assistant Examiner*—Thomas M. Kline
*Attorney, Agent, or Firm*—H. Duane Switzer

[57] ABSTRACT

A securing assembly for an axially rotatable body or workpiece such as a fluorescent lamp provided with a pair of pins which extend axially outward from at least one end thereof and into a socket in a lampholder. The securing assembly includes a generally C-shaped resilient body having a pair of radially inward extending locking members. These locking members are configured to prevent undesired rotation and subsequent disengagement of the lamp from the socket, even under severe vibration conditions. A securing or fastening device secures the resilient body to the holder.

24 Claims, 6 Drawing Figures

LOCKING ASSEMBLY FOR FLUORESCENT LAMPS

BACKGROUND OF THE INVENTION

This invention generally pertains to the art of locking assemblies. More specifically, the present invention relates to a locking assembly which is used to lock a fluorescent lamp in the socket of an associated lampholder.

The invention is particularly applicable to straight-line type fluorescent lamps and will be described with reference thereto. However, it will be appreciated by those skilled in the art that the invention has broader applications, and may also be adapted to use in many other environments in which it is necessary to secure in place axially rotatable bodies which have pins or other protrusions extending therefrom into associated sockets or retainers.

Heretofore, it has been difficult to securely lock fluorescent lamps in their associated sockets or holders. One prior type of locking device grips the lamp through a complex spring and lever arrangement. Such device, however, is not self-actuating, and the installer must remember to fully engage the mechanism before it will function effectively. Moreover, because the arrangement is complicated, it is expensive and sometimes prone to failure.

Another prior locking device includes a flexible insulator piece mounted directly to the lampholder. Upon installation of the lamp, the insulator piece rotates slightly to engage detents. This type of device, however, is not intended for use in environments where severe vibration is encountered, eg., factory or industrial and shipboard applications.

Yet another prior locking device includes a loose plastic clip which snaps over a standard lampholder and has a channel to engage the lamp pins. This system generally is used during shipment of the lamp fixture in an assembled condition, and it generally is contemplated that the lamp clips will be discarded after installation. In order to retain the lamp clips, the installer must follow special instructions and remember to reinstall the clips. Such clips also are not designed for use in long-term, severe vibration environments.

For high vibration environments such as marine or shipboard installations, several types of pedestal and plunger type lampholders have previously been utilized. These lampholders are, however, not usable in traditional short width shipboard designs such as the "T" bar drop-in fluorescent fixture design or the low profile fluorescent fixture design. Lampholders of the butt-on type do offer a shallow depth, but such lamps are held in the lampholders by light detents in the electrical contacts and, thus, do not prevent rotation of the lamp in the lampholder and displacement of the lamp under severe vibration conditions.

Accordingly, it has been considered desirable to develop a new and improved securing assembly which would overcome the foregoing difficulties and others while providing better and more advantageous overall results.

BRIEF SUMMARY OF THE INVENTION

In accordance with the present invention, a securing assembly is provided for an axially rotatable workpiece having pins extending axially outward therefrom at least at one end thereof for receipt by a socket or holder. The assembly includes a resilient body adapted to be placed in surrounding relation with the body, and has locking members extending radially inward thereof. The locking members readily permit rotational installation of the workpiece into the socket or holder, and thereafter resist further rotation and ultimate disengagement of the workpiece from the socket, even under severe vibration conditions.

In accordance with another aspect of the invention, a securing means is provided for securing the resilient body to the socket, holder, or adjacent structure, and includes a mounting portion associated with the resilient body. This mounting portion, in turn, includes means for fixedly securing the mounting portion to an associated holder. In the preferred embodiment, mechanical fasteners are advantageously employed to secure the mounting portion directly to the socket or holder.

According to one embodiment of the invention, the mounting portion of the securing means is formed integral with the resilient body. In another embodiment, the mounting portion is separate from the resilient body and includes means for releasably receiving the body.

According to a further aspect of the invention, the resilient body is generally C-shaped and the end areas thereof may be flexed resiliently outward from a first or normal position in response to rotational movement of the workpiece into an installed position in the associated socket or holder.

According to the preferred field of use of the invention, the workpiece comprises a fluorescent lamp or tube having a pair of contact pins extending axially outward from at least one end thereof. These pins are transversely spaced apart from each other by some predetermined distance. The locking members are spaced apart so that the facing edges thereof define a passageway having a width less than the transverse distance between the contact pins.

In accordance with still another aspect of the invention, the locking members are provided with opposed notch areas in the facing edges thereof. These notch areas allow the lamp contact pins to be seated in an installed condition in an associated socket without contact from the locking members while resisting undesired lamp rotation from the installed position.

In accordance with yet another aspect of the invention, the locking members are constructed of a non-conductive material and the resilient body is constructed of spring steel.

The principal advantage of the present invention is the provision of a new securing assembly which can prevent the rotation and subsequent disengagement of a workpiece from a retaining socket or holder.

Another advantage resides in the provision of such a securing assembly for a fluorescent lamp which provides a strong mechanical lock for the lamp in an installed position.

Another advantage of the invention is the provision of a securing assembly which automatically locks a fluorescent lamp in position while allowing a simple means for lamp removal.

A further advantage of the present invention is the provision of an assembly which is capable of securing a lamp in a shallow depth lampholder of the type used in most marine applications.

Still other benefits and advantages of the invention will become apparent to those skilled in the art upon a reading and understanding of the following detailed specification.

BRIEF DESCRIPTION OF THE DRAWINGS

The Invention may take physical form in certain parts and arrangements of parts, preferred and alternate embodiments of which will be described in this specification and illustrated in the accompanying drawings which form a part hereof, and wherein.

DETAILED DESCRIPTION OF THE PREFERRED AND ALTERNATE EMBODIMENTS

Figure 1:
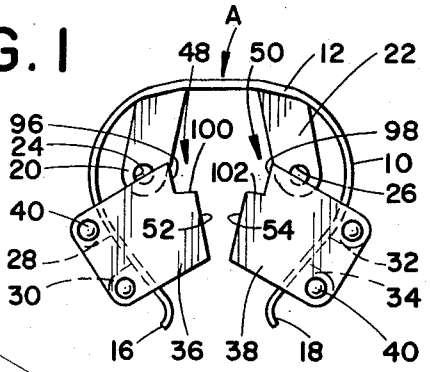
FIG. 1 is a front elevational view of the subject new securing assembly.

Referring now to the drawings, wherein the showings are for purposes of illustrating preferred and alternate embodiments of the invention only and not for purposes of limiting same, FIG. 1 shows the subject new securing assembly A. While the securing assembly is primarily designed for and will hereinafter be described in connection with a lampholder B and a fluorescent lamp C as shown in FIG. 2, it will be appreciated that the overall inventive concept can also be adapted to use in other environments in which it is necessary to mountingly secure an axially rotatable body having axially outward extending protrusions.

Figure 2:
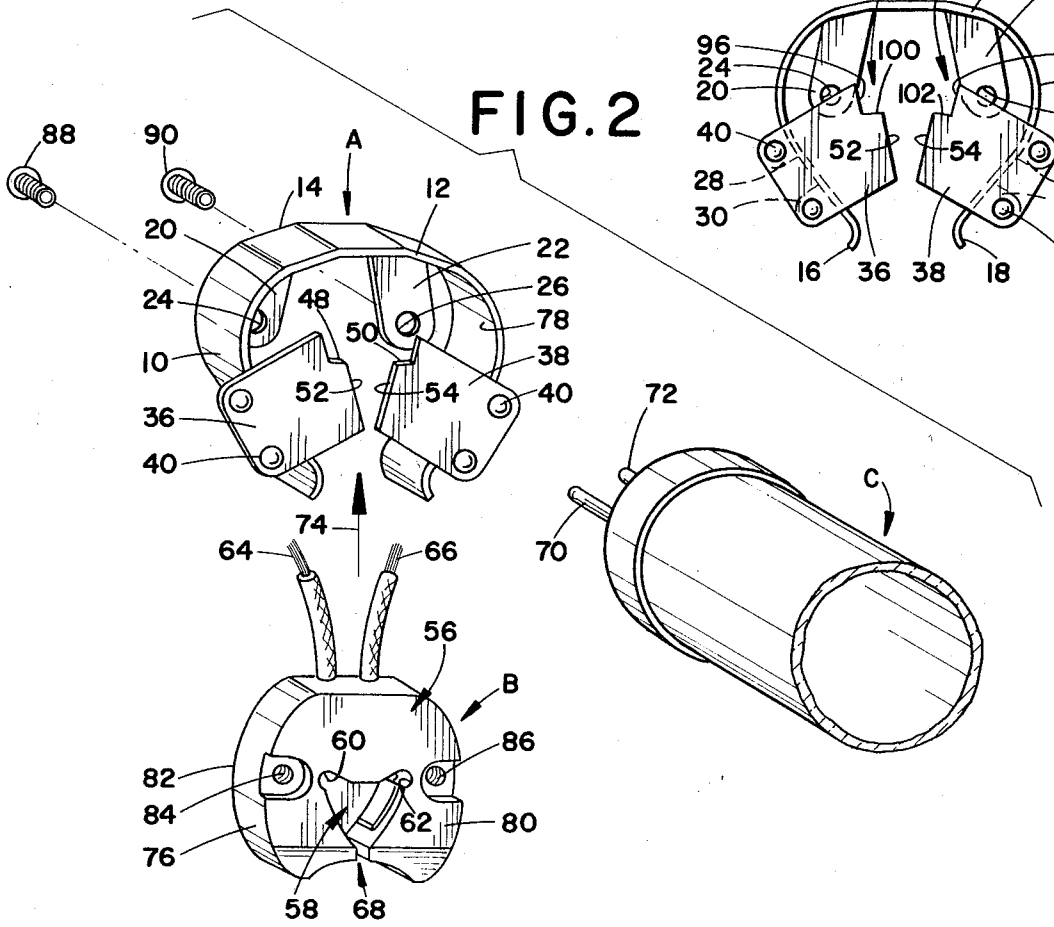
FIG. 2 is an exploded perspective view of the securing assembly of FIG. 1 and also showing a fluorescent lamp and a lampholder.

More particularly, securing member A is provided with a resilient band-like body 10 having a front edge 12 and a rear edge 14 (FIG. 2). In the preferred construction, body 10 is constructed of a light spring steel, although other spring-like or resilient materials could also be suitably employed. Preferably, body 10 is generally C-shaped and has a pair of spaced apart free end areas 16, 18. Depending from the rear edge 14 of the body 10 generally normal to the body is a mounting portion comprised of a pair of integral first tabs 20, 22 having apertures 24, 26, respectively, therethrough. The front edge 12 of body 10 has depending therefrom four integral second tabs 28, 30, 32, 34 as shown in dashed outline in FIG. 1.

Tabs 28, 30 support a locking member 36 and tabs 32, 34 support a similar locking member 38 in opposed relation to member 36. A plurality of rivets 40 or other convenient retaining means may be used to secure locking members 36, 38 to their respective tabs. The locking members are preferably planar, and are provided with notches 48, 50, respectively. These notches are disposed in opposed relation along adjacent locking member inner edges 52, 54, and retainingly engage an associated fluorescent tube in a manner to be described. For reasons which will also become apparent, the locking members are constructed from an electrically insulating material in the embodiment here under discussion, and a high density polyethylene plastic or the like is preferred.

With reference now to FIG. 2, the preferred use of the securing member A is in connection with lampholder B for fluorescent lamp C. The lampholder is conventional and may take a variety of different forms. As shown, however, the lampholder includes a body 56 having a somewhat triangular central aperture or socket 58 therein containing first and second electrical contacts 60, 62. These electrical contacts are electrically connected to first and second electric leads 64, 66 which, in turn, extend to a suitable source of electrical energy (not shown). An axial groove or slot 68 is provided in the front face of lampholder body 56 for allowing a pair of contact pins 70, 72 extending axially outward of fluorescent lamp C to be inserted into socket 58 during lamp installation. When the tube lamp C is thereafter rotated in the socket, pins 70, 72 are moved into contact with socket contacts 60, 62 in order that the lamp can be energized.

The generally C-shaped resilient body 10 is configured and dimensioned so as to be placed in a surrounding relationship with lampholder B. When ends 16, 18 of the body are flexed outwardly away from each other a sufficient distance, lampholder B can be inserted into body 10 as shown by the arrow 74. Once so installed, side periphery 76 of the lampholder is substantially encircled by an inner periphery 78 of the body. At the same time, a front surface 80 of the lampholder body 56 is positioned inwardly adjacent locking members 36, 38 while a rear surface 82 of the lampholder is positioned inwardly adjacent first tabs 20, 22.

The lampholder also contains a pair of threaded apertures 84, 86 adapted to be aligned with first tab apertures 24, 26 and receive a respective one of a pair of fasteners 88, 90. These fasteners thus function to fixedly secure body 10 to the lampholder. A fixture panel (not shown) may also be provided, and fasteners 88, 90 may conveniently extend therethrough for securing the lampholder to the fixture panel. Other mounting arrangements also may advantageously be employed to accommodate structural variations in the several different components involved.

Figure 3:
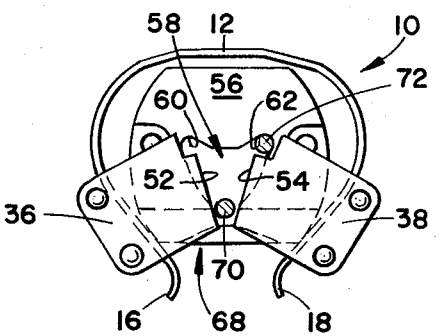
FIG. 3 is a schematic front elevational view of the securing assembly with the fluorescent lamp contact pins disposed at an initial position of installation in a socket.
Figure 4:
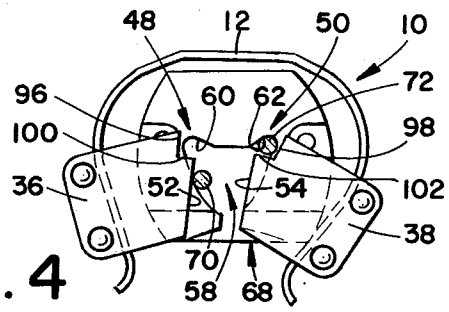
FIG. 4 is a view similar to FIG. 3 showing the contact pins as the fluorescent lamp has been rotated to a partially installed position in the socket.

Description will hereinafter be made with reference to FIGS. 3–5 and the functioning of securing assembly A after it has been installed on lampholder B. It will be appreciated that a conventional fluorescent lamp fixture has a pair of the lampholders disposed in a predetermined spaced apart, facing relationship with each other. Either one or both of the lampholders may include an associated securing assembly; however, the following description will relate only to a single assembly. Operation or functioning of a second assembly is identical thereto unless otherwise specifically noted.

During lamp installation with body 10 in a first or normal position, facing edges 52, 54 of locking members 36, 38 define a passageway for allowing pins 70, 72 to pass therebetween as the pins are moved into socket 58 from groove or slot 68 (FIG. 3) as is conventional. Also, edges 52, 54 are tapered relative to each other so that the passageway defined therebetween increases in width from the area disposed adjacent socket slot or groove 68 toward notches 48, 50. The maximum width of the passageway defined between edges 52, 54 is designed to be less than the maximum width of socket 58, and is also less than the transverse distance between pins 70, 72. As a result of the foregoing relationship, edges 52, 54 act as bearing surfaces which allow transmittal of lamp installation forces to securing member A. That is, as lamp C is rotated so that pins 70, 72 are moved toward engagement with contacts 60, 62 (FIG. 4), at least one of the pins engages one of edges 52, 54 and effectively urges the edges away from each other, ie., flexes body 10 against the inherent spring characteristics thereof to a second position, to permit continuation of lamp rotation.

As the lamp pins approach a rotated, installed position in cooperative engagement with contacts 60, 62 (FIG. 5), the pins enter notches 48, 50 defined in locking members 36, 38. In the first position of body 10, the outer side edges 96, 98 of the notches are spaced apart from each other a slightly greater distance than the transverse distance between pins 70, 72. Therefore, as the tube pins enter notches 48, 50 and approach seated engagement with contacts 60, 62, body 10 is free to spring back to its normal, relaxed position with edges 52, 54 of locking members 36, 38 shifted back toward each other. Because of the dimensioning between notch side edges 96, 98, these side edges will not interfere with or engage contact pins 70, 72 so as to impair the cooperative relationship between the pins and socket contacts. Furthermore, the lower edges 100, 102 of the notches prevent rotation of the lamp out of the installed, cooperative position with the socket contacts due to vibrations and other such forces normally encountered in industrial and shipboard environments.

In order to subsequently remove fluorescent lamp C from socket 58 of the lampholder, exertion of a spreading force on the free end areas 16, 18 of body 10 and a concurrent rotational movement of fluorescent lamp C will readily accommodate lamp removal from the lampholder. Upon release, the body returns automatically to the original position.

Spring body 10, as mentioned. is preferably made of a spring steel material so that a linearly increasing force is required to spread ends 16, 18 increasing distances apart. Naturally, the spring constant can be controlled by selecting the appropriate type of material and controlling the other dimensional characteristics thereof. If a spring steel is used for body 10, the material hardening process for the steel will also have some effect on the spring constant. The proper spring constant will have to be a compromise between the strength of the lamp holding force and the force which it takes to spread ends 16, 18 for purposes of installing the device on lampholder B.

Figure 5:
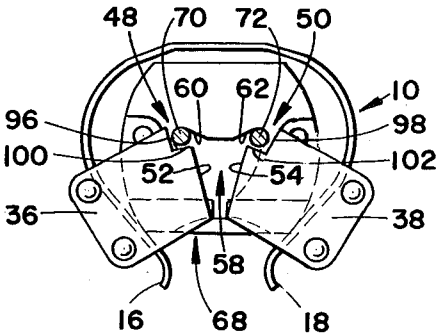
FIG. 5 is also a view similar to FIG. 3 showing the contact pins as the fluorescent lamp has been rotated to the fully installed position; and, FIG. 6 is an exploded perspective view of an alternate embodiment of the subject new securing assembly.

With reference now to the alternate embodiment of FIG. 5, the invention is there shown as having a modified securing arrangement. For ease of illustration and appreciation of this alternative, like components are identified by like numerals with primed (') suffix and new components are identified by numerals.

Figure 6:
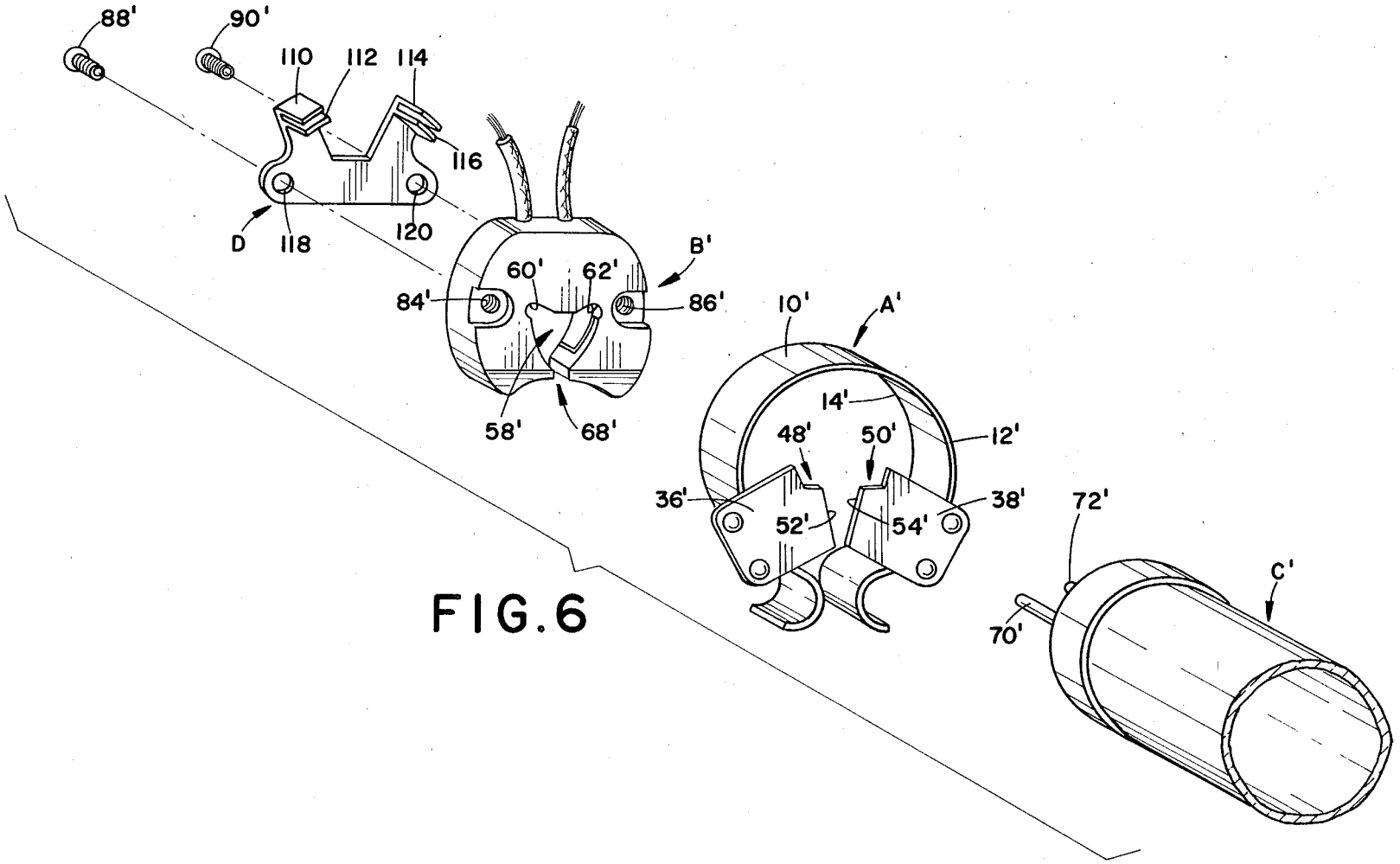

In FIG. 6, a securing member A' is provided with a separate clip or mounting portion D. The securing member is preferably, again, made of a spring steel material while the clip member is made of a dielectric material. The clip or mounting portion is provided with two pairs of clamping flanges 110, 112 and 114, 116. The flanges or fingers in each pair are spaced apart to define a receiving channel for receiving and gripping spring body 10'. A pair of apertures 118, 120 are also provided in the clip member to accommodate a pair of fasteners 88', 90' for fixedly securing the clip to an associated lampholder B'.

As in the preferred embodiment, fasteners 88', 90' extend into respective apertures 84', 86' in the lampholder. In this way, clip D is secured directly to the lampholder while securing member A' is secured to and retained by clamping flange pairs 110, 112 and 114, 116. In this alternative, lampholder B' can be placed within securing member A' by insertion from the rear edge 14' thereof, and clip D can then be secured to the lampholder as well as to the securing member. Operation of this embodiment is substantially identical to the preferred embodiment described above.

The subject invention provides a new securing assembly which is simple to manufacture and install, and which provides a strong mechanical lock to withstand even severe vibrational forces. The invention imposes no additional installation requirements while operating automatically to lock a rotatable workpiece in position and allowing a simple means of removal. When the invention is used for fluorescent lamps in marine applications, it also offers a shallow depth which is necessary for the conventional low profile or T-bar drop-in marine fluorescent fixtures.

The invention has been described with reference to preferred and alternate embodiments. Obviously, modifications and alterations will occur to others upon a reading and understanding of this specification. For example, depending upon the specific socket conformation, it may be necessary to modify the shape of the securing assembly body, the conformation of the mounting portion, etc. However, it is intended to include all such modifications and alterations insofar as they come within the scope of the appended claims or the equivalents thereof.

Having thus described the invention, it is now claimed:

1. A device for securing a workpiece having axially outward extending pins at one end thereof in an installed position in an associated holder, and wherein the workpiece is rotatable about its longitudinal axis for moving the pins thereof from an installation condition to an installed condition in the holder, said device comprising:

a generally C-shaped resilient body adapted to be placed in a surrounding relationship with the outer periphery of an associated holder, said body having a pair of spaced apart end areas shiftable relative to each other between a first normal position and a second expanded condition in response to rotation of a workpiece from an installation condition to an installed condition in the associated holder;

a pair of locking members extending generally radially inward toward each other from one side edge of said body and terminating in facing edges which are spaced apart from each other for defining a passageway therebetween, the pins of a workpiece installed in the associated holder adapted to pass through said passageway in the workpiece installation condition and act against said locking members for moving said body end areas to said expanded condition as the workpiece is rotated toward the installed position, said body automatically moving back to said normal position when the workpiece is in the installed condition to provide locking means for restricting the ease with which the workpiece may be further rotated; and, means for cooperably mounting said body relative to an associated holder.

2. The device of claim 1 wherein said mounting means includes a mounting portion extending generally radially inward of said body at the side edge thereof opposite from said one side edge, and further includes means cooperating with said mounting portion for fixedly securing said mounting portion to an associated holder.

3. The device of claim 2 wherein said mounting portion is integral with said body and said device further includes means for electrically insulating said mounting portion from an associated holder.

4. The device of claim 2 wherein said mounting portion is defined by a pair of tabs integral with said body, said tabs including apertures therethrough for receiving mechanical fasteners adapted to secure said mounting portion to an associated holder with said body in a predetermined located relationship therewith.

5. The device of claim 2 wherein said mounting portion includes a receiving portion for releasably receiving said body in a desired relative orientation.

6. The device of claim 5 wherein said receiving portion comprises a pair of spaced apart flanges extending outwardly of said mounting portion in a direction generally normal thereto, said flanges defining a body receiving channel therebetween for releasably receiving said body from said opposite side edge thereof.

7. The device of claim 5 wherein said mounting means is constructed from a dielectric material.

8. The device of claim 1 wherein said resilient body end areas include curved portions extending outwardly of each other.

9. The device of claim 1 wherein said pair of locking members comprise planar portions disposed adjacent said end areas of said body on opposed portions of said on side edge of said body.

10. The device of claim 9 wherein said facing edges of said locking members are relatively positioned in the first normal position of said body such that said passageway increases in width from a passageway entrance area, the maximum width of said passageway being less than the transverse distance between the axially outward extending pins in a workpiece adapted to be installed in the associated holder.

11. The device of claim 10 wherein said locking members include opposed notches in said facing edges at areas thereof spaced from said passageway entrance area, said notches being spaced apart and dimensioned for allowing the pins of a workpiece disposed in an installed condition in an associated holder to be in a non-contacting relationship with said locking members while resisting rotation of the workpiece out of an installed condition.

12. The device of claim 9 wherein said planar portions are constructed of a dielectric material and are separately affixed to said body.

13. The device of claim 1 wherein said resilient body is constructed of spring steel.

14. A securing assembly for a fluorescent type lamp having a pair of electrical contact pins extending axially outward from at least one end thereof into a lampholder socket, and wherein said lamp is rotatable between a first installation condition and a second installed condition in said socket, said assembly comprising in combination:

a resiliently deformable body disposed in an encircling relationship with at least a major portion of the periphery of said lampholder;

a pair of non-conductive locking members extending generally radially inward of said body and terminating in spaced apart facing edges which define a passageway therebetween for receiving said lamp pins in said lamp installation condition, said passageway having a width between said facing edges in a first normal position of said body which is less than the transverse distance between said pins, said facing edges being shifted away from each other in a second position of said body in response to contact from said pins as said lamp is rotated from said installation condition toward said installed condition and said body being shifted automatically back to said first position when said lamp is in said installed position; and, means associated with locking members for resisting rotation of said lamp from said installed position.

15. The assembly of claim 14 wherein said resisting means comprises notches in said locking members communicating with said passageway, said notches having a maximum dimension therebetween in said body first position which is greater than the transverse distance between said lamp pins so as to be in a non-contacting relationship with said pins in said lamp installed condition.

16. The assembly of claim 15 wherein said passageway increases in width along said facing edges from an entrance area toward said notches.

17. The assembly of claim 14 wherein said body has spaced apart end areas, said locking members being planar and extending radially inward of said body from adjacent said end areas.

18. The assembly of claim 17 further including means for mounting said body to said socket, said mounting means cooperating with said body intermediate said locking members for allowing shifting of said body between said first and second positions.

19. The assembly of claim 14 wherein said lamp pins communicate with a front face of socket, said locking members being planar and extending from one side edge of said body in a covering relationship with a portion of said front face.

20. The assembly of claim 19 further including means for mounting said body to said socket, said mounting means including a mounting portion which extends from a side edge of said body opposite said one side edge into a covering relationship with a portion of a rear face of said socket spaced from said front face.

21. The assembly of claim 14 further including means for cooperably mounting said body to said socket wherein said mounting means includes a mounting portion extending radially inward of said body and fasteners passing through said mounting portion into said socket for securing said body thereto, said mounting means being disposed at a rear edge of said body with said locking members being disposed at a front edge of said body.

22. The assembly of claim 21 wherein said mounting portion is integral with said body.

23. The assembly of claim 21 wherein said mounting portion is releasably secured to said body.

24. The assembly of claim 23 wherein said mounting portion includes a receiving channel for releasably receiving said body from said rear edge thereof.

* * * * *